US010322920B2

(12) United States Patent
Shi

(10) Patent No.: US 10,322,920 B2
(45) Date of Patent: Jun. 18, 2019

(54) SCISSOR-BOOM LIFT

(71) Applicant: DongFeng Shi, Sammamish, WA (US)

(72) Inventor: DongFeng Shi, Sammamish, WA (US)

( * ) Notice: Subject to any disclaimer, the term of this patent is extended or adjusted under 35 U.S.C. 154(b) by 59 days.

(21) Appl. No.: 15/472,702

(22) Filed: Mar. 29, 2017

(65) Prior Publication Data

US 2017/0283229 A1 Oct. 5, 2017

(51) Int. Cl.
*B66F 11/04* (2006.01)
*B66F 17/00* (2006.01)

(52) U.S. Cl.
CPC ..... *B66F 11/042* (2013.01); *B66F 17/006* (2013.01)

(58) Field of Classification Search
CPC ..... B66F 11/042; B66F 17/006
See application file for complete search history.

(56) References Cited

U.S. PATENT DOCUMENTS 366,365 A * 7/1887 Averberg
2,402,579 A * 6/1946 Ross ..... B66F 3/22 182/15
3,352,380 A * 11/1967 Barney ..... A01D 46/20 182/131
3,446,379 A * 5/1969 Phillips ..... B60P 1/025 182/141
3,709,322 A * 1/1973 Mitchell ..... B66F 11/04 182/148
3,920,096 A * 11/1975 Fisher ..... B66F 11/042 182/14
4,356,887 A * 11/1982 Fisher ..... B66F 11/042 182/148
4,691,805 A 9/1987 Kishi
5,740,887 A 4/1998 Unger et al.
6,330,933 B1 * 12/2001 Boeckman ..... B66F 11/042 182/18
8,678,135 B2 * 3/2014 Crook ..... B66F 11/042 182/62.5
2004/0144594 A1 * 7/2004 Cunniffe ..... E04G 3/26 182/142

* cited by examiner

*Primary Examiner* — Alvin C Chin-Shue
(74) *Attorney, Agent, or Firm* — Mohr Intellectual Property Law Solutions, PC

(57) ABSTRACT

A scissor boom system including a scissor boom assembly having a telescopic boom section including a base-boom, a middle-boom, and a top-boom, a scissor links assembly, a chassis, and a power hoist. The chassis supports the power hoist, the power moves the telescopic boom section and the scissor links assembly between raised and lowered conditions when manipulated. The scissor boom assembly provides a stable work platform for workers. The telescopic boom section provides for horizontal-movement of a work platform, and the scissor links assembly is thus able to provide vertical-movement of the work platform, as desired.

10 Claims, 13 Drawing Sheets

SCISSOR-BOOM LIFT

CROSS REFERENCE TO RELATED APPLICATIONS

This application claims priority to copending Chinese Application, Serial No. ZL 2016 2 20250971.6, filed on Mar. 29, 2016, which is hereby incorporated by reference for all purposes.

BACKGROUND

The present disclosure relates generally to lifting devices. In particular, a scissor-boom lift is described.

Known lifting devices are currently grouped into 2 categories: (1) The scissor lifts, which use the scissor links folding and unfolding to change the lifts height and they have no far outreach capability (2) The boom lifts, which use the telescope booms' extension, retraction and angel movement to change the lifts top platform height and outreach distance. Current lifts are not entirely satisfactory for the range of applications in which they are employed. For example, scissor lifts do not have far outreach capability and thus their application are very limited. Boom lifts are complicated to operate and expensive to own.

Thus, there exists a need for lifting devices that improve upon and advance the design of known lifting devices. Examples of new and useful lifting device relevant to the needs existing in the field are discussed below.

Examples of references relevant to lifting means include U.S. Pat. Nos. 6,330,933; 4,691,805, and 5,740,887. The complete disclosures of the above patents and patent applications are herein incorporated by reference for all purposes.

SUMMARY

The present disclosure is directed to a scissor-boom lift. In some examples, scissor-boom lift includes a scissor boom assembly having a horizontal telescopic boom assembly at the top including a base-boom, a middle-boom, and a top-boom which also acts as the platform, a scissor links assembly in the middle, and a chassis at the bottom. The 3-section horizontal telescope boom, powered by a power hoist, can extend or retract to change the platform's outreach distance. The scissor links, powered by a hydraulic cylinder, can fold and unfold to change the platform's working height. The chassis, with 2 front steering wheels and 2 rear wheels, allows the scissor-boom lift to travel and turn. All above mentioned movement can be controlled separately by a single joystick located inside the platform.

Compared to the current scissor lifts on the markets, the scissor-boom lift provides an outreach capability when the 3 section horizontal telescopic boom extend out and thus can reach those working objects that scissor lifts cannot reach. Compared to the current boom lifts on the market, the scissor-boom lift is much cheaper in cost and also simpler to control and maintain.

DETAILED DESCRIPTION

The disclosed lifting device will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various lifting devices are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
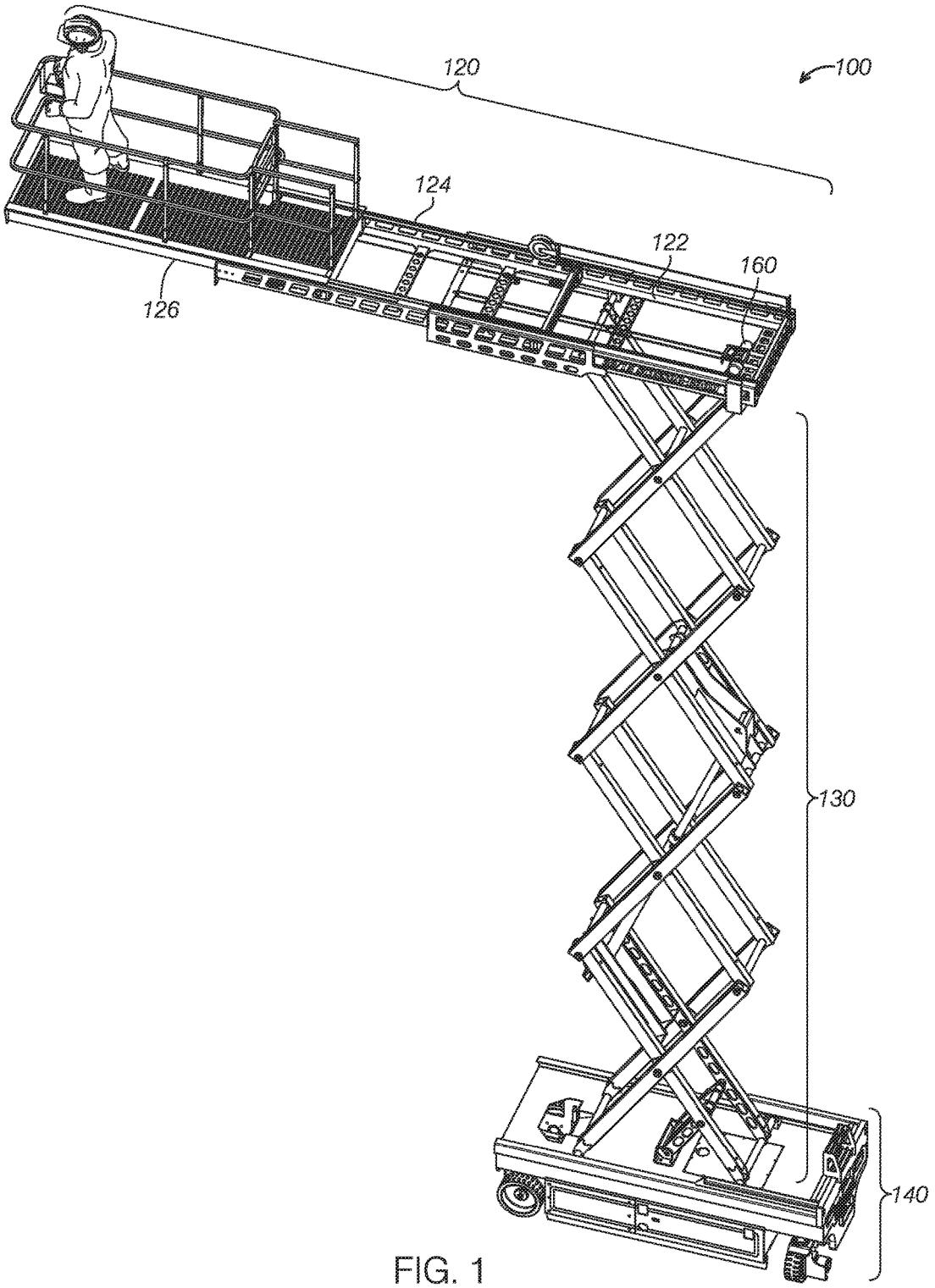
FIG. 1 is a perspective view of a first example of a scissor-boom lift in an in-use condition, an operator operating the device via a handheld controller; the device in a raised position.

Generally speaking, the present invention refers to a new scissor-boom lift as shown in FIG. 1 which includes a 3-section telescopic boom 120 at the top that can extents or retracts horizontally, a scissor link assembly 130 in the 'mid' that can fold or unfold vertically and a chassis 140 at the bottom that can travel or turn. Each of these movements can be controlled separately by a joystick controller located inside the working platform.

Figure 2:
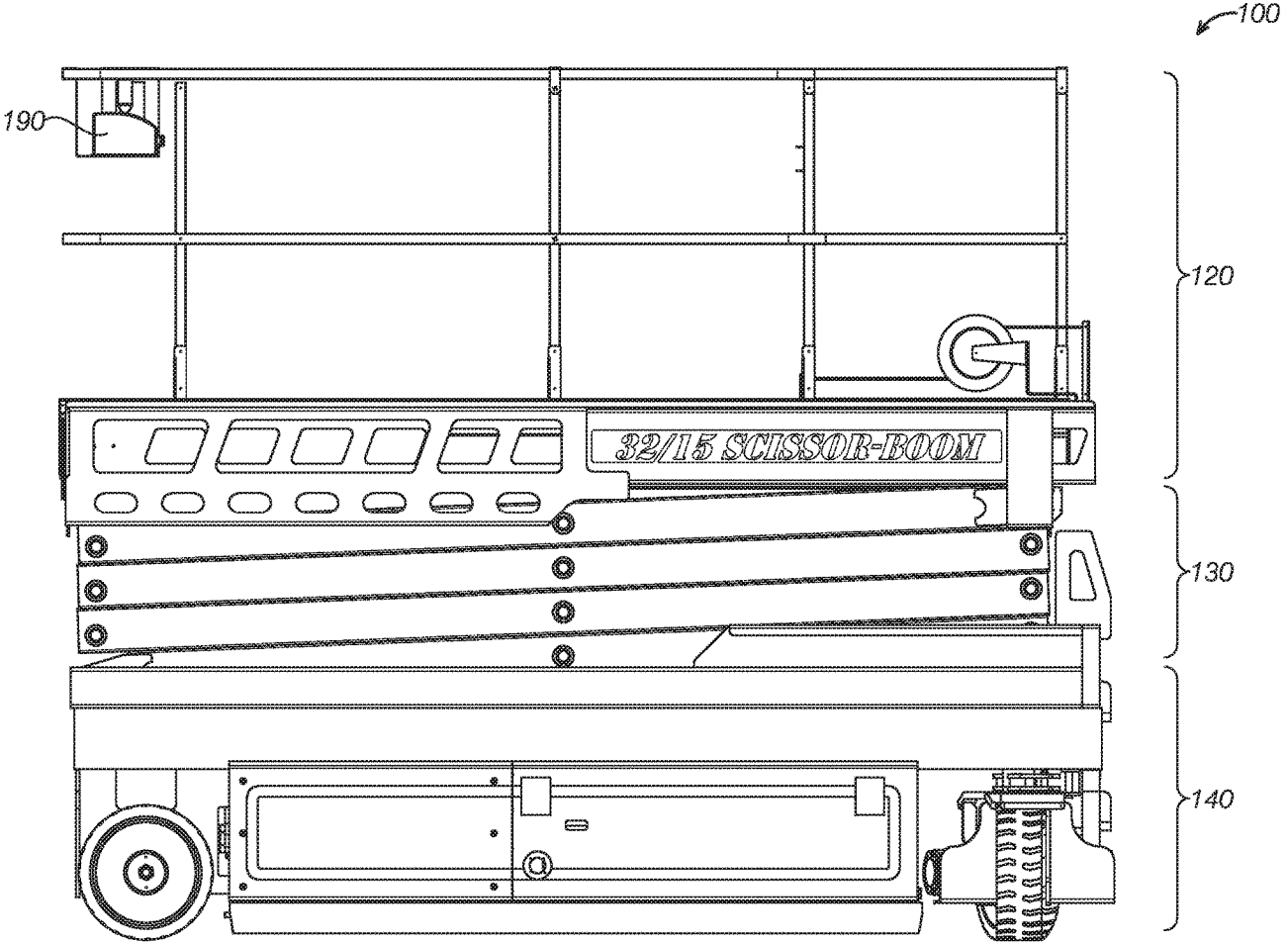
FIG. 2 is a perspective view of the scissor-boom lift shown in FIG. 1 depicting the device in a stored position for transport.

With reference now to FIGS. 1-5, a first example of a scissor-boom lift 100; scissor-boom lift 100, will now be described. Scissor-boom lift 100 functions to provide an adjustable work platform with vertical-movement and horizontal-movement of the work platform, as desired. The reader will appreciate from the figures and description below that scissor-boom lift 100 addresses shortcomings of conventional lifting devices. As shown in FIG. 1, a scissor-boom lift 100 at a fully extended and raised position is disclosed herein including a telescopic boom assembly 120 at the top including a base-boom 122, a middle-boom 124, and a top-boom 126, a scissor links assembly 130 in the middle, and a chassis 140 at the bottom. FIG. 2 shows the scissor-boom lift 100 in a stored position, with the top telescopic boom section 120 fully retracted and the scissor links 130 fully folded.

Figure 3:
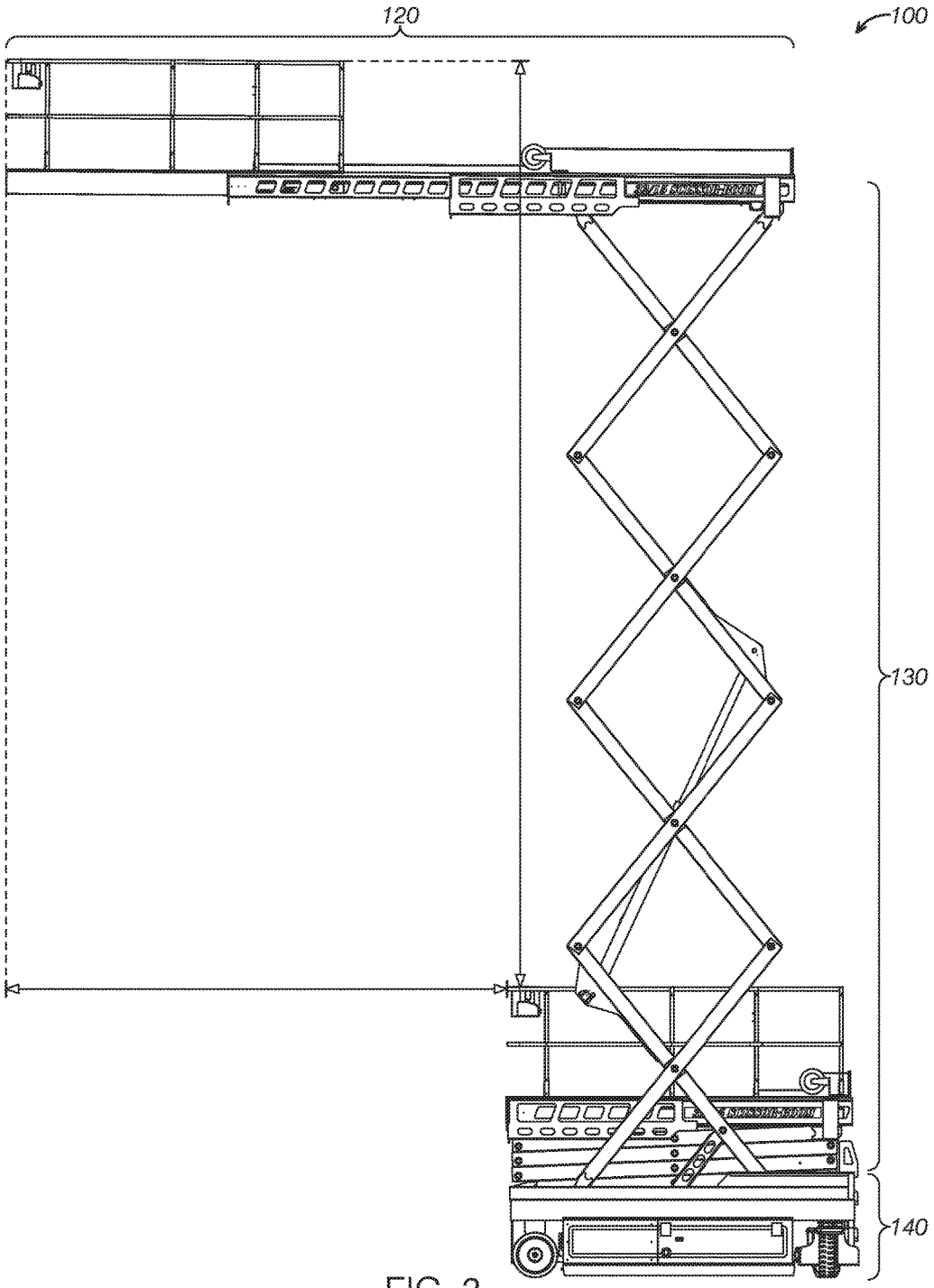
FIG. 3 is a perspective view of the scissor-boom lift showing the device horizontal and vertical movement range with indication arrows between stored position and the fully extended and raised position.
Figure 4:
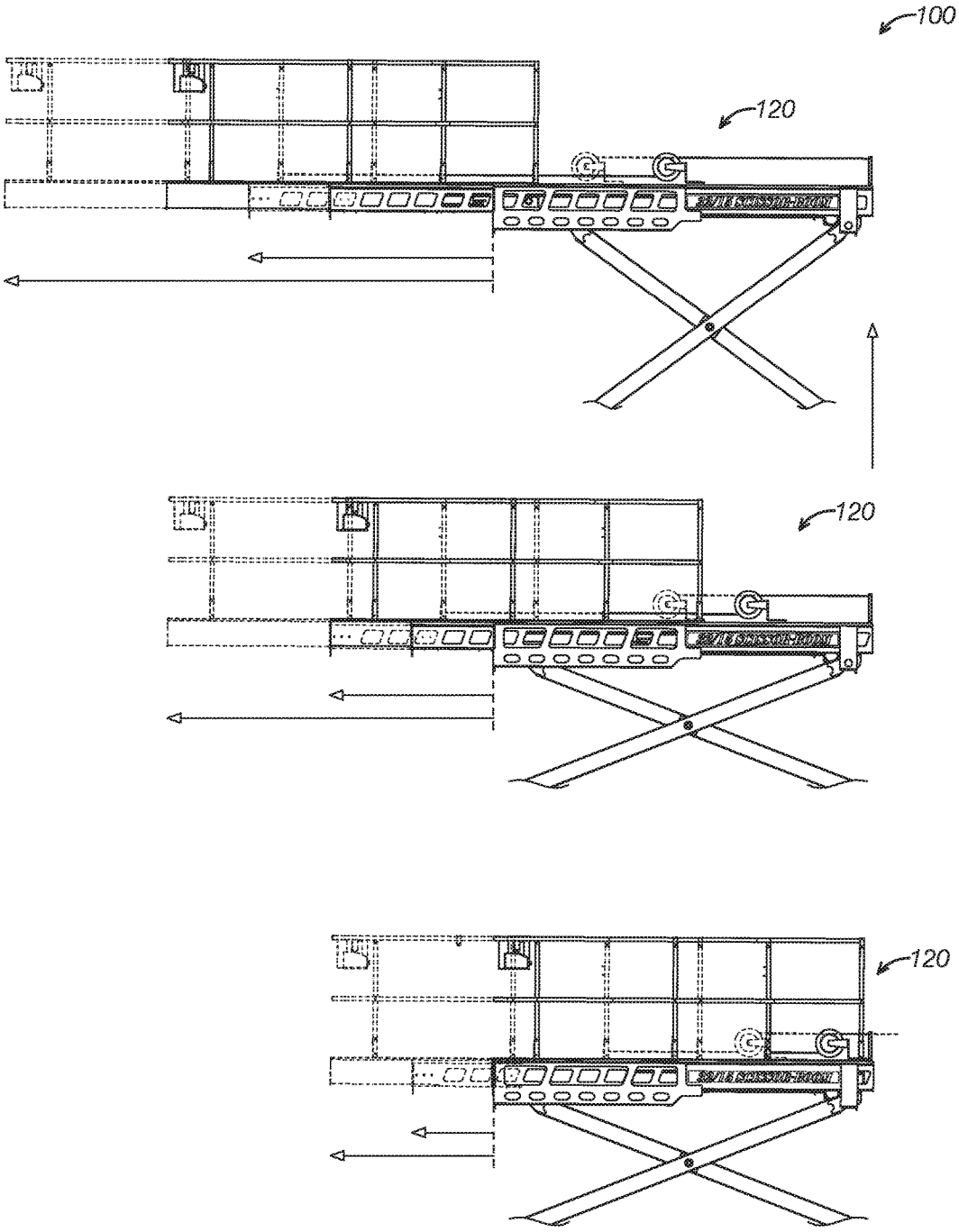
FIG. 4 is a perspective view of a second example of a scissor-boom lift including the top section of the device moving horizontally out and up from the lowered portion.
Figure 5:
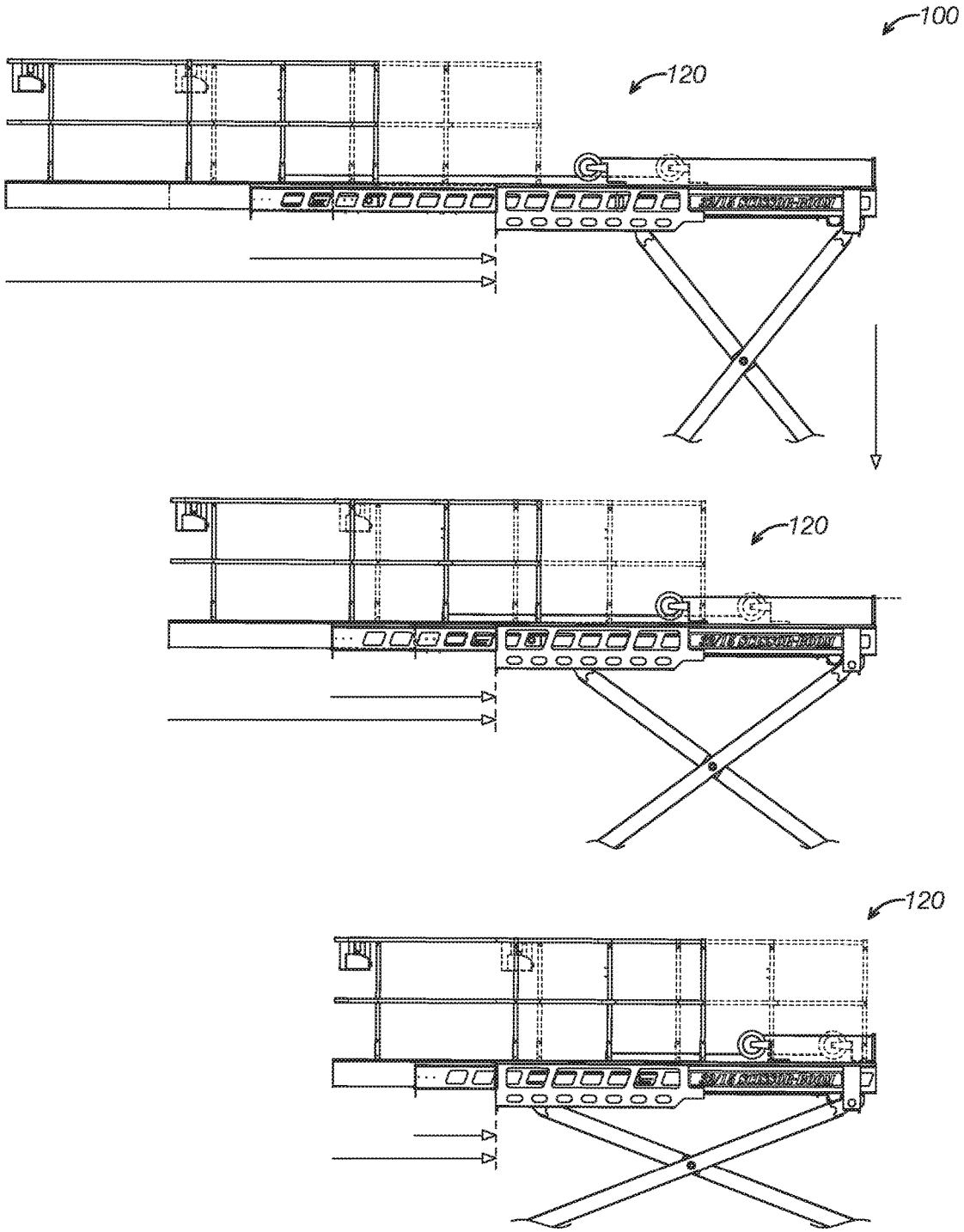
FIG. 5 is a perspective view of a second example of a scissor-boom lift including the top section of the device moving horizontally in and down from the raised portion.

The telescope boom assembly 120, is coupled to the scissor links assembly 130 and powered by power hoist 160 located at the front end of base boom 122, providing a stable work platform for workers as shown in FIG. 1 and also provides for horizontal-movement of a work platform as shown in FIGS. 3-5. FIG. 3 shows the range of vertical and horizontal movement of the platform from stored position to the fully extended and raised position. The scissor links assembly 130, powered by hydraulic cylinder, supports the top telescopic boom assembly 120 and provides the vertical-movement of the work platform. The chassis 140 supports the scissor link assembly 130 and can travel and turn. It also supports the counterweights at the front end to counterbalance the tipping moment.

FIG. 4 shows the telescopic boom assembly 120 making the simultaneously extension and the scissor links unfolding movement from retracted and lowered position to the extended and raised position and FIG. 5 shows the telescopic boom assembly 120 making the simultaneously retraction and the scissor links folding movement from extended and raised position to the retracted and lowered position. The details of the telescopic boom assembly 120, the scissor link assembly 130 and the chassis 140 will be depicted below with reference to the drawings.

Figure 9:
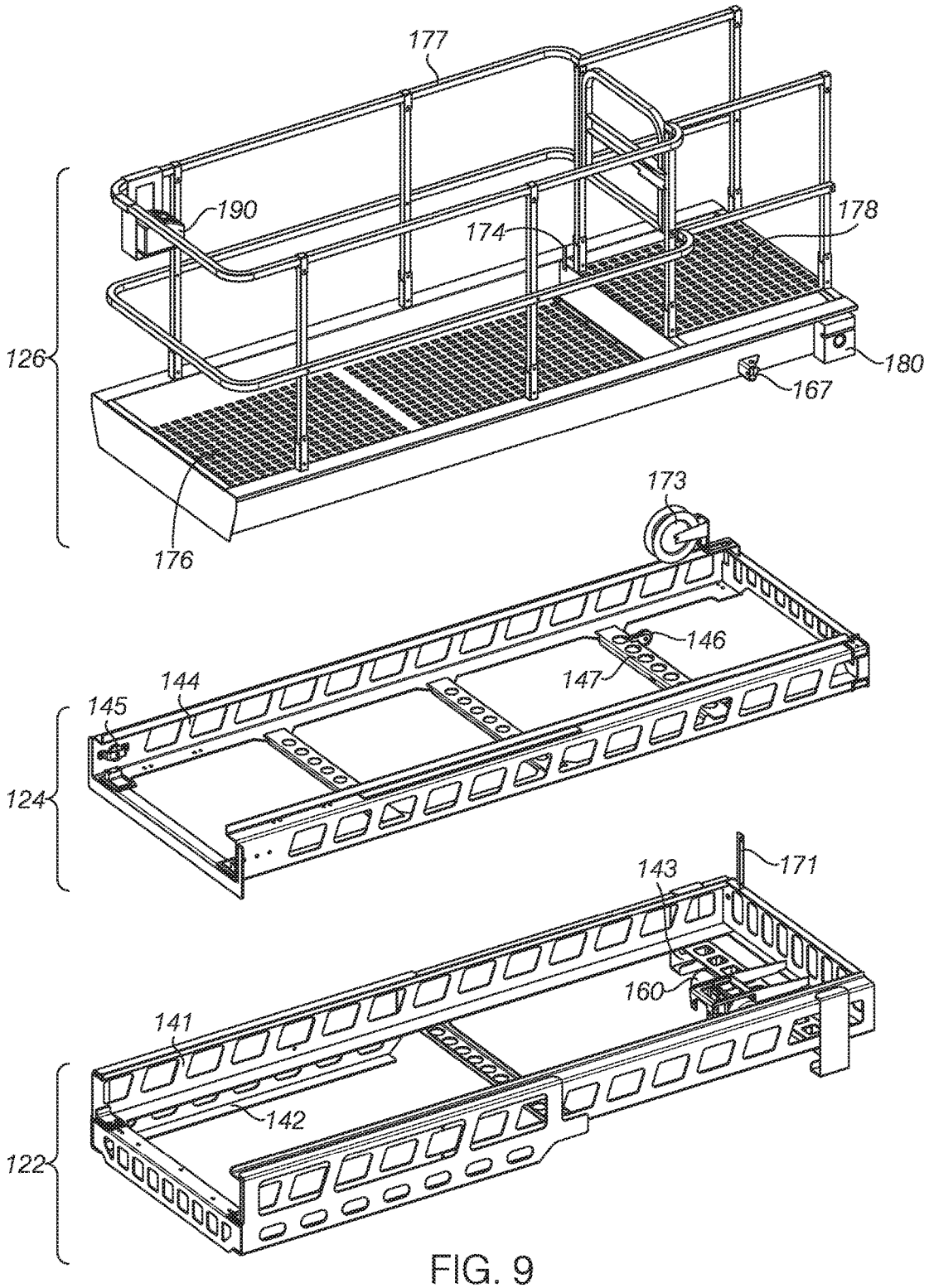
FIG. 9 is a perspective view of the top-boom, middle boom and base boom major structure.

Telescopic boom assembly 120, as shown in FIG. 1; the 3-section telescopic boom assembly 120 includes the base-boom 122, the middle-boom 124, and the top-boom 126. The top-boom 126 also acts as the platform for a worker. As shown in FIG. 9, the base-boom 122 has a top-base-boom-channel 141 on top right side and top left side allowing the middle-boom 124 to nest in and slide along the top-base-boom-channel 141. The base-boom 122 also includes the pivot pin bracket 143 at the bottom front to pivot to a top front scissor link 135 (135 will be described subsequently).

The base-boom 122 has a bottom-base-boom-channel 142 at bottom left side and bottom right side of the rear half that allows a top rear link 138 to sit in through a sliding block 185 (138 and 185 will be described subsequently) and slide along the base-boom-channel 142 when the scissor links assembly 130 folds and unfolds. The base-boom 122 further includes the control cable bracket 171 at the front end for holding the control cable when the platform extends and retracts. The top of the base-boom 122 are open so the top-boom 126 and middle-boom 124 can slide all the way into the top open space when fully retracted.

A power hoist 160 is preferably mounted at the front bottom of the base-boom 122 to provide power for telescopic boom assembly 120's extension and retraction. As shown in FIG. 9, the middle-boom 124 has a middle-boom-channel 144 on both sides of the top allowing the top-boom 126 to sit in and slide along when the top-boom 126 extends and retracts. The outside of the middle-boom-channel 144 sits inside the top base-boom-channel 141 and slide along when middle-boom 124 extends and retracts. The middle boom 124 also comprises an extension cable vertical pulley 145 mounted at the rear end inside the right and left middle-boom-channel 144. The middle-boom 124 also comprises a retraction cable pulley 146 mounted at the left and right side of a cross beam 147 at the bottom close to the front end of the middle-boom 124. The middle-boom 124 further comprises a control cable retractable drum 173 mounted at a front end of the middle-boom 124.

As shown in FIG. 9, the top-boom 126 has a working floor 176 and rail 177 on the top rear half of top-boom 126 that form a working platform allowing an operator to stand during work. A control box 190 is hanged on the rail 177. The top-boom 126 also has the walking surface 178 at the front end of the top-boom 126 that allows the operator to walk through to get in or leave the working platform. A sliding block 180 is pivoted to each side of the top boom 126 at the front end and the sliding block 180 is fitted into the middle-boom-channel 144 allowing the top-boom 126 to slide along the middle-boom-channel 144. An extension cable horizontal pulley 167 is mounted on each side of the top boom 126 next to the sliding block 180.

Figure 6:
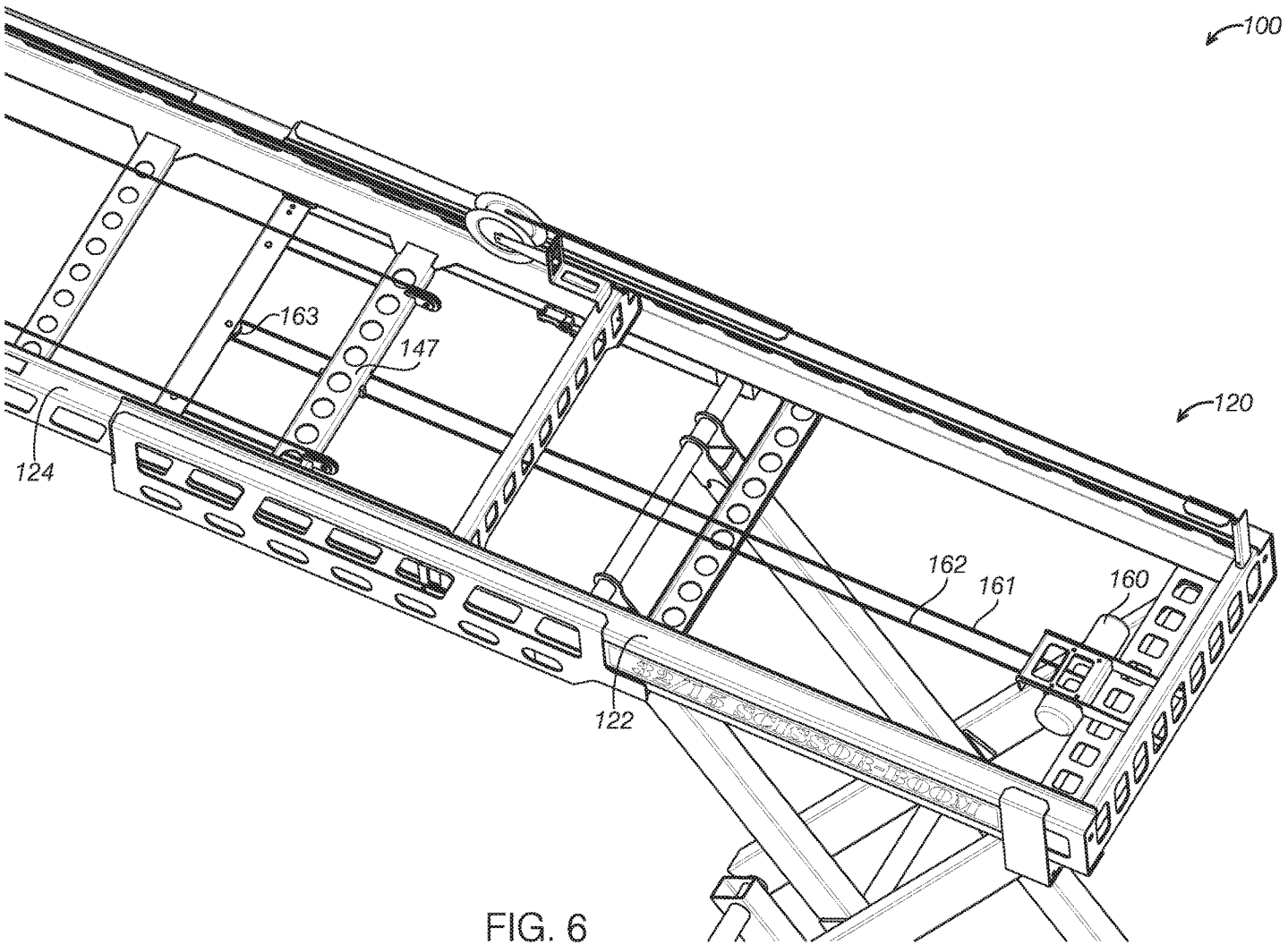
FIG. 6 is a perspective view of the telescopic middle-boom extent and retract movement mechanism of the scissor-boom lift.

FIG. 6 illustrates how the middle-boom 124 extents and retracts; a middle-boom extension cable 161 and a middle-boom retraction cable 162 are mounted to the power hoist 160 on one end, with one cable wrapping to the power hoist 160 from the bottom and the other cable wrapping to the power hoist 160 from the top so at any time when the power hoist 160 rotates, one cable will be wrapped into and the other one will be wrapped out from the power hoist 160. The other end of the middle-boom extension cable 161 goes over a cable pulley 163 mounted at the bottom rear end of base-boom 122, turns 180 degree there and then is fixed to the cross beam 147 on the middle-boom 124.

The other end of the middle-boom retraction cable 162 is directly fixed to the cross beam 147. The power hoist 160, middle-boom extension cable 161, cable pulley 163, cross beam 147 and middle-boom retraction cable 162 form a closed loop. When the power hoist 160 rotates, if the middle-boom extension cable 161 is wrapped into the power hoist 160, it will pull the cross-beam 146 away from the power hoist 160 through cable pulley 163 and thus the middle-boom 124 will extend out of the base-boom 122; if the middle-boom retraction cable 162 is wrapped into the power hoist 160, it will pull the cross-beam 146 toward power hoist 160 directly and thus the middle-boom 124 will retract into the base-boom 122. The operator can control the middle-boom 124's extension or retraction by controlling the power hoist 160 rotation direction through control box 190.

Figure 7:
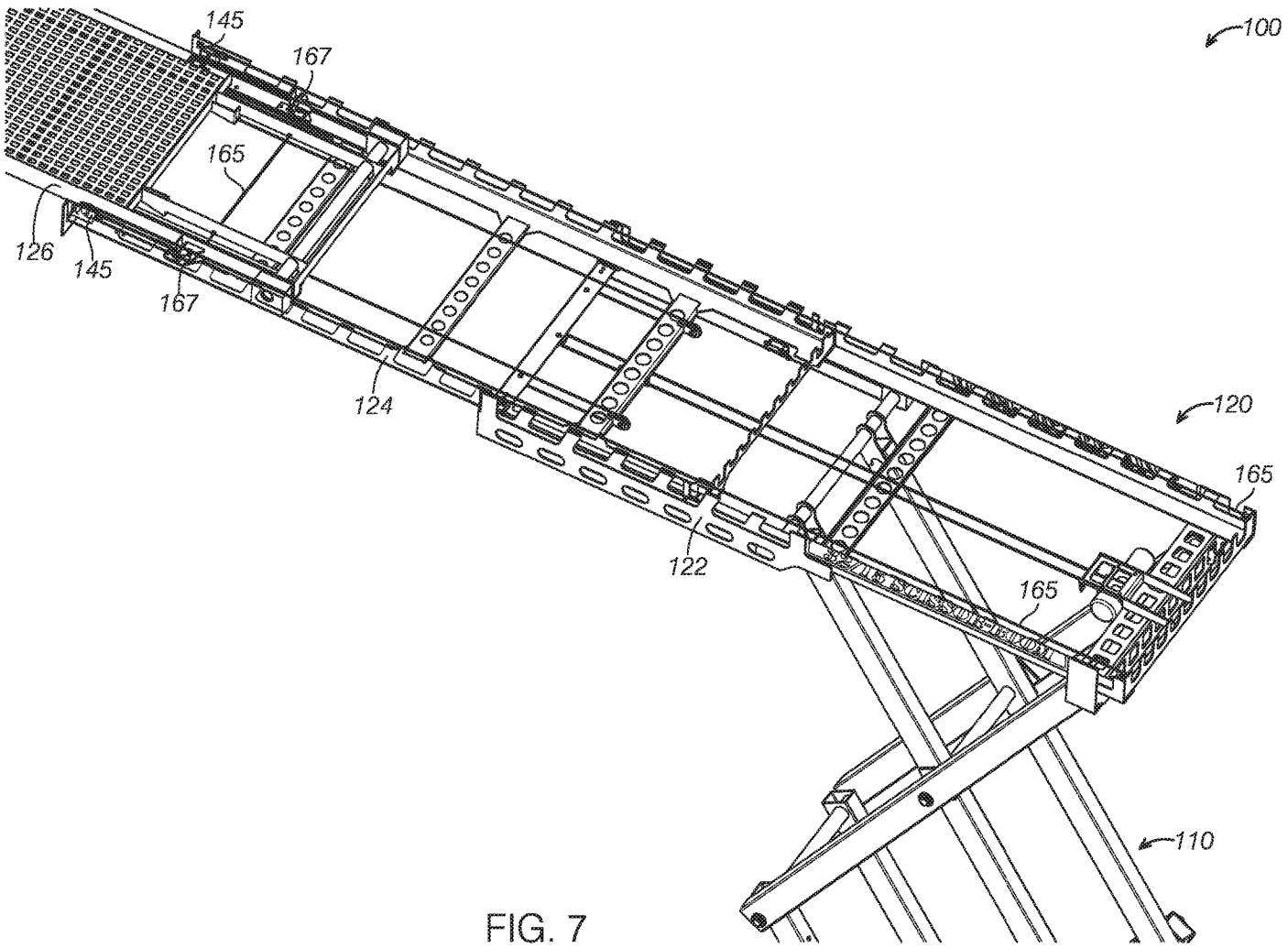
FIG. 7 is a perspective view of the telescopic top-boom simultaneous extending mechanism of the scissor-boom lift.

As shown in FIG. 7, the top-boom 126 extends simultaneously when middle-boom 124 extends since a top-boom extension cable 165 is used to push top-boom 126 out of middle-boom 124 when middle-boom 124 extents. The path of the top boom extension cable 165 starts with its one end fixed to the right front end of the base boom 122, the other end goes inside and along the base-boom top channel 141 and middle-boom channel 144 on the right side to wrap on the right extension vertical pulley 145 located at the rear end of the middle-boom channel 124 and makes the 180 degree turn, then it wraps onto the right horizontal pulley 167 located at the front bottom of top-boom 126 and makes a 90 degree turn to wrap onto the left horizontal pulley 167, it turns 90 degree again there and then goes to wrap onto the left extension vertical pulley 145 located at the rear end the middle-boom 124 on the other side. Then it goes inside and along the middle-boom channel 144 and base-boom top channel 141 on this side and finally is fixed to the front end of base-boom 122. When the power hoist 160 rotates and pushes middle-boom 124 to extend backwardly, the right and left extension vertical pulley 145 move together with middle-boom 124 and thus will push the top boom extension cable 165 to move backward also. Since the two ends of the top boom extension cable 165 are fixed to the base-boom 122's front end and thus do not move, then the middle section of the top boom extension cable 165 that goes between the right and left extension horizontal pulley 167 of the top-boom 126 will move backward at the double speed of the middle-boom 124 and thus push the top-boom 126 to extent simultaneously out of the middle-boom 124 when middle-boom 124 extends.

Figure 8:
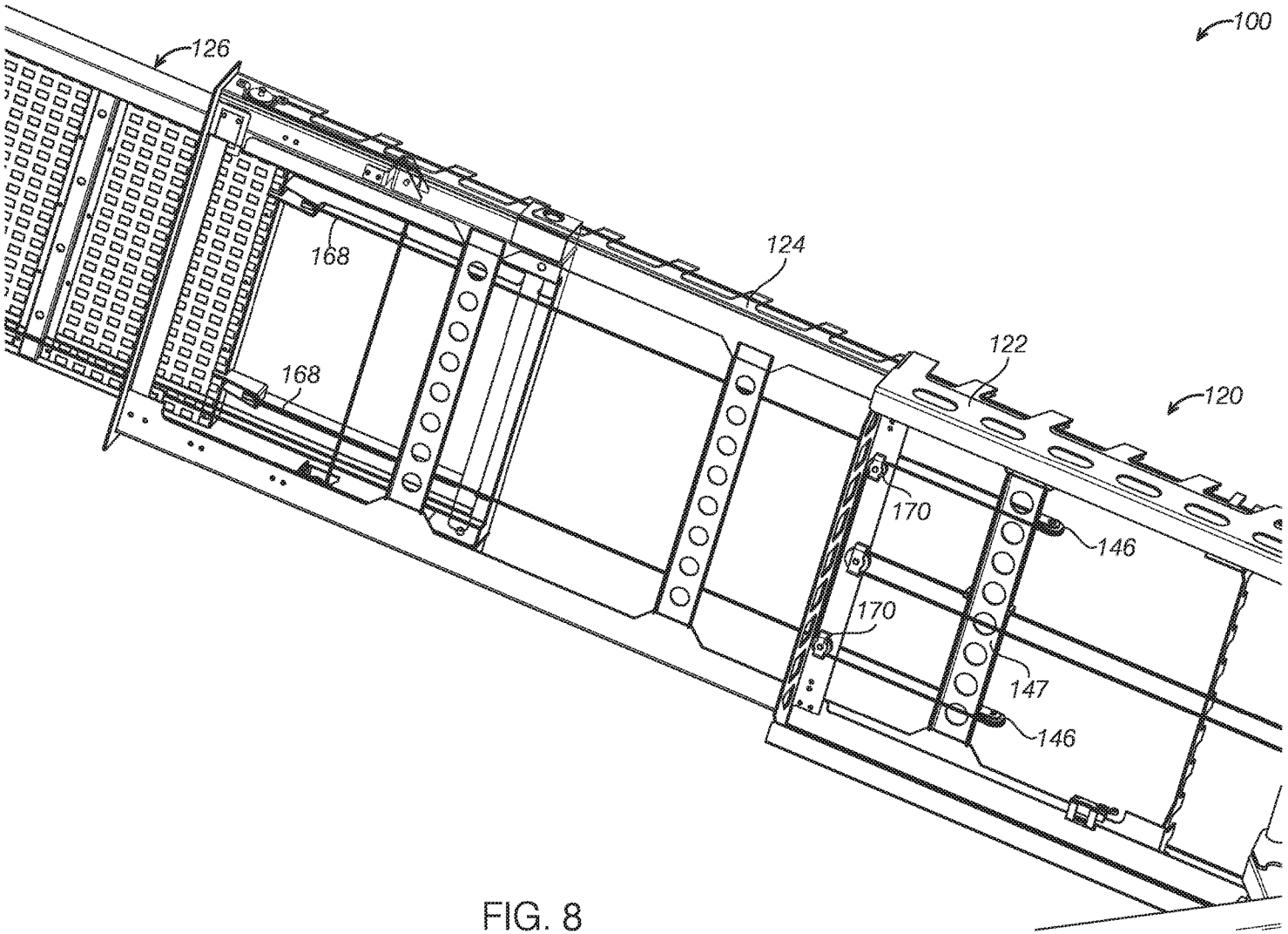
FIG. 8 is a perspective view of the telescopic top-boom simultaneous retracting mechanism of the scissor-boom lift.

As shown in FIG. 8, the top-boom 126 retracts simultaneously when the middle-boom 124 retracts since a top-boom retraction cable 168 is used to pull the top-boom 126 back to middle-boom 124 simultaneously when middle-boom 124 retracts. The path of the top-boom retraction cable 168 starts with its one end anchored to the right bottom at the front half of the top-boom 126, the other end of the retraction cable 168 goes through the bottom of the middle-boom 124 and wraps onto the top boom retraction pulley 146 mounted at the cross beam 147 at the bottom right front of the middle-boom 124 and makes 180 degree turn. It then passes through the right horizontal pulley 170 mounted at the rear end of base-boom 122 and makes 90 degree turns to go to the other horizontal pulley 170 on the left and makes another 90 degree turn there. It then passes through the other pulley 169 mounted at the bottom left front of the middle-boom 124, makes 180 degree turns there and then goes through the bottom of the middle-boom 124 and then finally be anchored to the left bottom at the front half of top-boom 126.

When the middle-boom 124 retracts into the base-boom 122, the two top boom retraction cable pulleys 169 mounted at the bottom front of the middle-boom 124 move together with the middle-boom 124 and thus pull the top boom retraction cable 168 to move toward the front end of the base-boom 122. Since the middle section of the top boom retraction cable 168 that goes between the two horizontal pulley 170 mounted at the bottom rear of the base-boom 122 will not move, the two end of the top boom retraction cable 168 that are anchored to the top-boom 126's bottom front will be pulled at the double speed of the middle-boom 124 retraction movement and thus the top-boom 126 is then pulled simultaneously to move towards the front end of the base-boom 122 when middle-boom 124 retracts.

Figure 10:
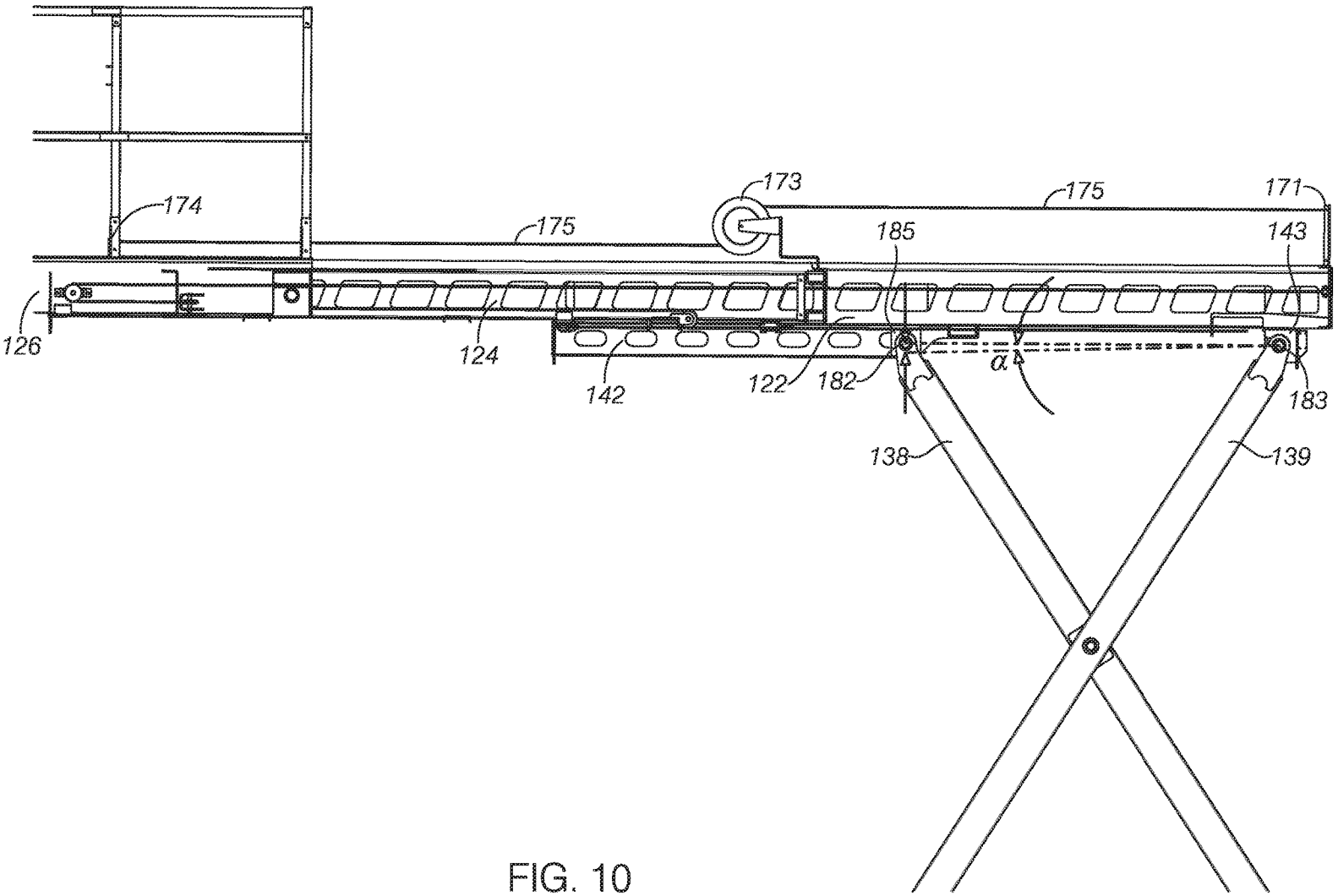
FIG. 10 is a sectioned view to show telescopic boom assembly connection to the scissor links and also the control cable retractable drum and bracket layout on the telescopic boom assembly.

The control box 190 is preferably located on the top-boom 126 and is connected to the scissor links assembly 130 and chassis 140 by control cable 175. As shown in FIG. 10, when the top-boom 126 extends or retracts, the control cable 175 will also expend or retract together with the top-boom 126. This is accomplished by a front cable bracket 172 mounted at the front end of base-boom 122, a rear cable bracket 174 mounted at the front half of the top-boom 126 and a retractable cable drum 173 mounted at the front end of middle-boom 124. The control cable 175's front end is fixed to the front cable bracket 172 on the base-boom 122, the rear end of the control cable 175 is rewound into the right half of the retractable cable drum 173 from the top for several rounds, then is turned 180 degree to be rewound to the left half of the retractable cable drum 173 for several rounds and is rewound out of the retractable cable drum 173 from the bottom and then anchored to the cable rear end bracket 174 on the top-boom 126 at the rear end. Since the control cable 175 is rewound into the retractable cable drum 173 from the top and rewound out from the bottom, so when retractable cable drum 173 rotates, it will rewind or unwind the top and bottom cable simultaneously in opposite direction.

The retractable cable drum 173 always rewinds the cable to its drum by either the springs or motor inside the drum and thus there is always tension on the control cable 175 to make it 'straight' all the time. When the middle-boom 124 extends, the top-boom 126 also extends twice the speed of the middle-boom 124 so the control cable 175 is pulled out from the retractable cable drum 173 from both the top and bottom when the middle-boom 124 and the top-boom 126 extend. When the middle-boom 124 and the top-boom 126 retracts, the control cable 175 is also retracted to the retractable cable drum 173 by the forces of springs or motor inside the drums from both the top and bottom.

Figure 12:
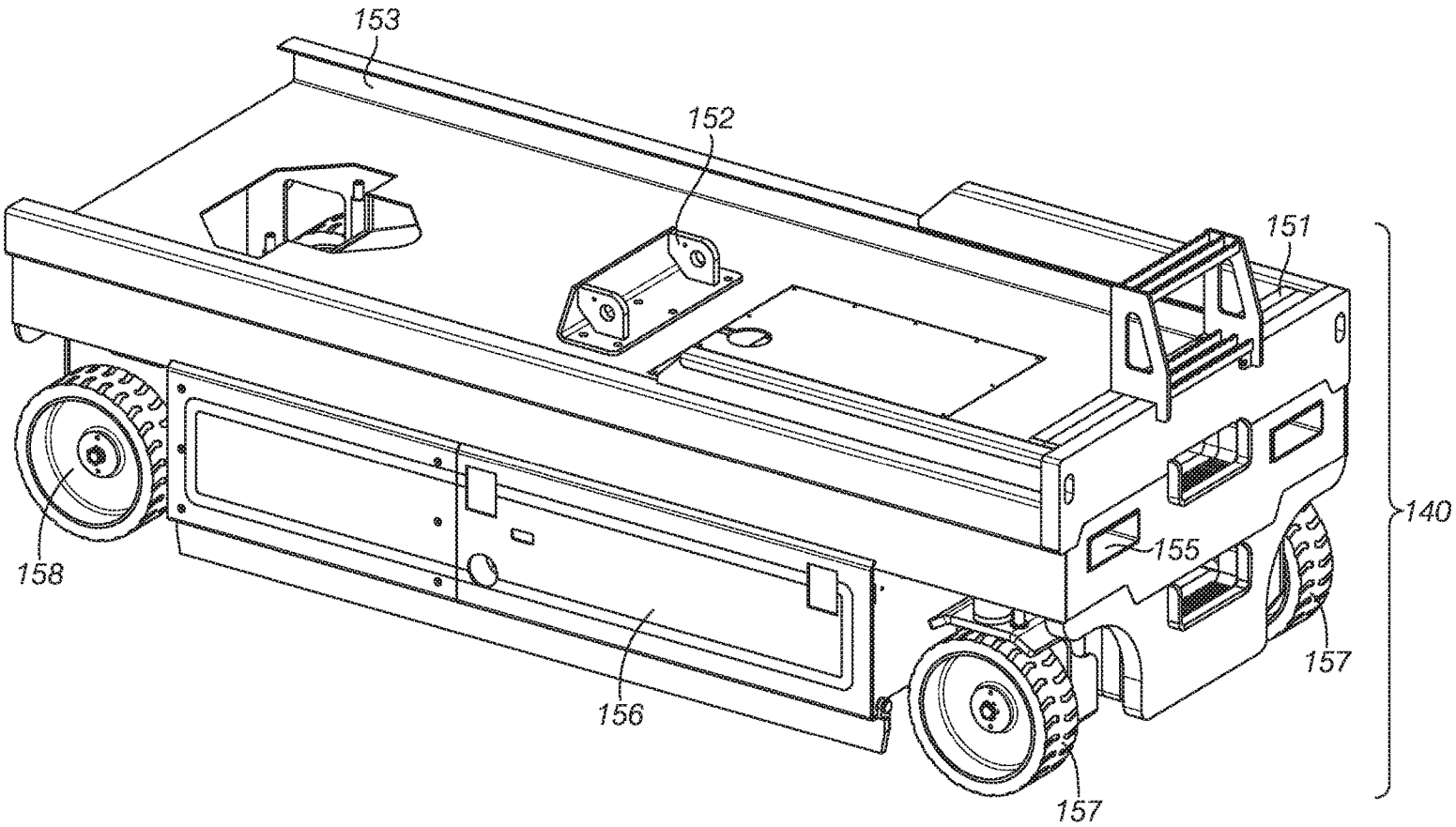
FIG. 12 is the perspective view of the chassis.
Figure 13:
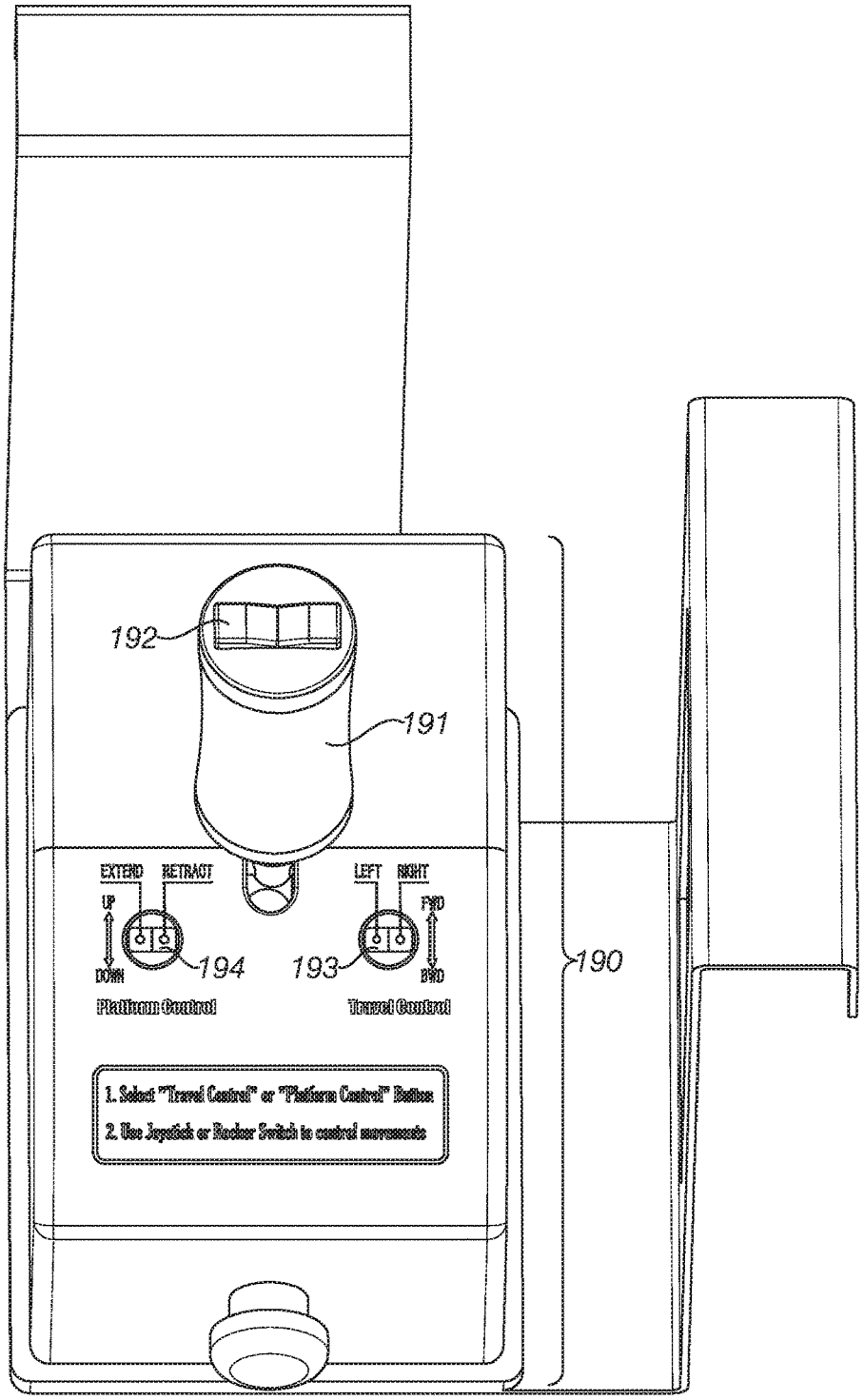
FIG. 13 is the perspective view of the single joystick controller controlling all the scissor-boom lift's movement.

As shown in FIG. 13, the control box 190 comprises of a joystick 191 and rock switch 192 that control both the chassis 140's travel and steering movement, as well as the top boom 126's vertical and horizontal movement. Also as shown in FIG. 12, on the control box 190, there are two control push buttons—travel control button 193 and platform control button 194 that can be selected to allow the operator to select which movement control to select. If the "Travel Control" button 193 is pushed, then the joystick 191 will control the chassis 140's forward and backward travel and the rock switch 192 will control the front wheels steering direction. If the "Platform Control" 194 button is pushed, then the joystick 191 will control the scissor links unfold or fold movement, allowing the platform to go up or down and the rock switch 192 will control the extension or retraction of the telescopic boom assembly 120's extension or retraction on the top, allowing the platform to outreach or retract in.

Figure 11:
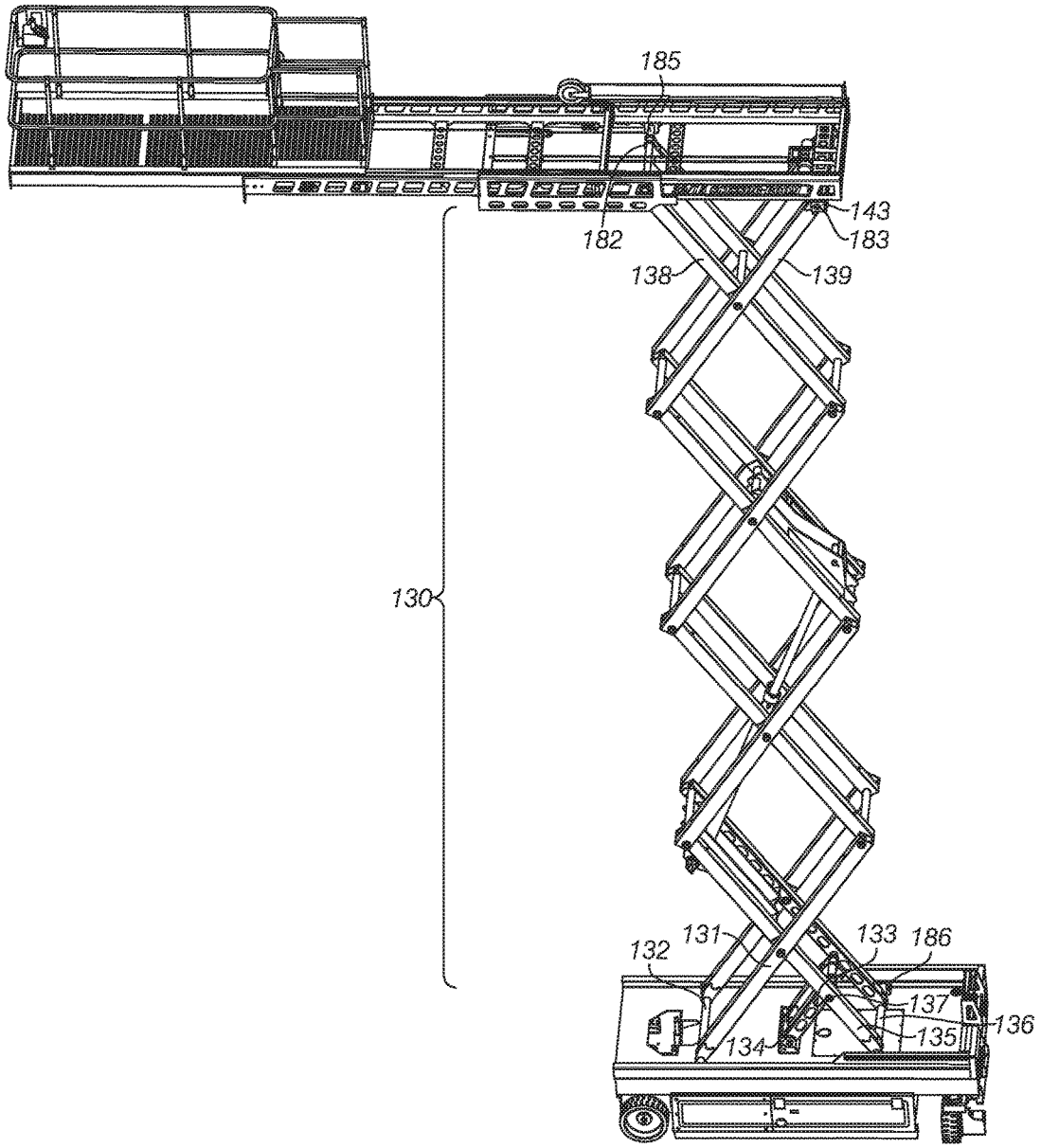
FIG. 11 is perspective view of the scissor links assembly and its connection to the telescopic boom assembly at the top and to the chassis at the bottom.

Referring now more specifically to scissor link assembly 130 as shown in FIG. 11; the scissor link assembly 130 includes a top front link 139 that is pivoted to the base-boom front bottom pin bracket 143 by pin 183, a top rear link 138 that is pivoted to a top sliding block 185 through a top pin 182. The sliding block 185 is fitted inside and can slide along the base bottom sliding channel 142 located at the bottom rear half of the base-boom 122. When scissor link assembly 130 folds and unfolds, since the top front link 139 is pivoted to the base-boom 122's front end by pin 183, so the top pin 182 of the top rear link 138 will slide along the base bottom sliding channel 142 on the base-boom 122 through sliding block 185.

Also as shown in FIG. 11, the scissor link assembly 130 includes a bottom rear link 131 with a bottom rear pin 132, a middle link 133 with a bottom middle pin 134 and top middle pin 137, and a bottom front link 135 with a bottom front pin 136. Bottom rear pin 132 and bottom front pin 136 fit inside can slide along the channel 143 (143 will be described late) on the chassis 140 through the bottom sliding block 186. The middle link 133's bottom end is pivoted to the chassis 140 by bottom middle pin 134 and the top end is pivoted to the bottom front link 135 by top middle pin 137. The center of rear bottom pin 132, the middle bottom pin 134 and the front bottom pin 136 are on the same horizontal surface and the middle link 133 is always parallel to bottom rear link 131 so when scissor links assembly 130 fold and unfold, the middle link 133 will swing around its bottom pivot link 134 and the rear bottom pin 132 and front bottom pin 136 will either move towards each other or apart from each other simultaneously and symmetrically with bottom middle pin 134 as the symmetric center. Thus the gravity center of the scissor links assembly 130 keeps unchanged and always stay at the center of the chassis 140.

In reference to the scissor links assembly 130, all scissor links pivot holes are preferably aligned horizontally except the top rear link 138 and top front link 139's top pivot pin 182 and 183 that connect the scissor links assembly 130 to the top base-boom 122. As shown in FIG. 10; the center of the top rear link pivot pin 182 is above that of the top front link pivot pin 183, causing the base-boom 122 not level, with its rear end tilted up by an angle α. As shown in FIG. 10, when the scissor links unfold and thus base boom 122 is raised up, the top sliding-block 185 and top rear pivot pin 182 will slide towards the front end of the base boom 122 and thus get closer to the top front pivot pin 183 which is pivoted at the pivot pin bracket 143 at the base-boom 122's front bottom. This movement will make the tilting angle α bigger so the further the unfold, the higher the rear end of the base boom 122 than its front end will be and thus the top boom 126 and middle boom 124 will all be tilted up on their rear end further. This angle α and thus the up tilt of the rear end of the base-boom 122 is used to partially offset the overall bending of the 3-section telescopic boom assembly 120 due to the gravity when fully extended and to keep the top-boom (the platform) 126 staying horizontal as much as possible.

Referring now to chassis 140 as shown in FIG. 12, the chassis in preferred embodiments has two front wheels 157 that have the driving motor to provide the 'travel power' and also two rear wheels 158. The two front wheels 157 may also steer and when they steer 90 degrees, they will be perpendicular to the rear wheels 158 and in this position when the two front wheels 157 travels, the whole chassis 140 will swing with one of the rear wheels 158 as the 'swing center'. The chassis 140 has sliding-channels 153 on both sides at the top that allow the bottom sliding-blocks 186 of the scissor links 130 to fit in and slide. The chassis 140 has a middle-link-pivot-bracket 152 bolted at the middle of the top of the chassis 140. The middle link 133 is pivoted at the bottom to the middle-link-pivot-bracket 152 so the middle link 133 can swing around the middle-link-pivot-bracket 152 when scissor links assembly 130 folds or unfolds. At the same time, since the middle link 133 is pivoted to the bottom front link 135 at the top, this swing and linkage make bottom front link pin 136 and bottom rear link pin 132 slide along channel 153 toward or apart from each other simultaneously through bottom sliding block 186, thus the center of the scissor links 130 does not change and always stays at the center of middle-link-pivot-bracket 152 on chassis 140.

As shown in FIG. 12, the chassis 140 further comprises the counterweight 151 at its front end above and between the two fronts wheels 157 and the counterweight 157 provides the counterbalance when the 3-section telescopic booms 120 extend 'to the backward' on the top. It also provides increased traction force for the front wheels 157 when the front wheels drive to travel. The chassis also comprises drawlers 156 located on each side of the front half of the chassis 140 just next to the front wheels. These drawlers 156 hold the battery and hydraulic components inside and also act as the counterbalance when the 3-section telescopic boom assembly 120 extends to the backward on the top. Each drawler is locked by the latch on the top to the chassis 140 and may be opened to gain access to the components inside. The combination of the counterweight 151 and drawlers 156 makes the gravity center of the whole lift much close to the front end of chassis 140 and when the 3 section telescopic boom assembly 120 extends backward, the gravity center will shift to the middle area of the chassis. Two forklift holes 155 are located at the front end of chassis 140 allowing the whole lift can be picked up by forklift when the lift is in the stored position.

When the front wheels 157 turn left to the nearly 90 degree and travel, the chassis 140 will then swing around the rear wheel on the left rear side. The 3 section telescopic boom assembly 120 will also then swing together with the chassis 140. This swing allows the platform to cover more working area on the right when extended. When the front wheels 157 turn right to the nearly 90 degree and travel, the chassis may swing around the rear wheel on the right rear side. The 3 section telescopic boom 120 will then swing together with the chassis 140. This swing allows the platform to cover more working area on the left when extended.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A scissor-boom lift, comprises:
- a chassis comprising:
  - a body;
  - a first set of wheels connected to a front of the body;
  - a second set of wheels connected to a back of the body; and
  - a counterweight connected to the back of the body;
- a scissor links assembly connected to a top of the body of the chassis, wherein the scissor links assembly comprises a first link pivotally interlinked with a second link, wherein the first link and second link are configured to fold and unfold to raise and lower along a vertical axis, respectively;
- a base boom connected to a top of the first link and a top of the second link, the base boom comprising:
  - a power hoist;
  - a first pulley is mounted at the front end of the base boom;
  - a first rail with a first channel extending along a side of the first rail;
  - a second rail with a second channel extending along a side of the second rail; and
  - a first crossbeam connecting the first rail to the second rail;
- a middle boom comprising:
  - a third rail configured to be inserted into the first channel such that the third rail telescopically extends and retracts along a horizontal plane relative to the base boom, wherein the third rail includes a third channel extending along a side of the third rail;

a fourth rail configured to be inserted into the second channel such that the fourth rail telescopically extends and retracts along the horizontal plane relative to the base boom, wherein the fourth rail includes a fourth channel extending along a side of the fourth rail;

a pivot pin bracket at a bottom front end of the base boom, the base boom is pivoted to a top rear link in the scissor links assembly at the pivot pin bracket, wherein the base boom includes a fifth channel at a front half of the base boom and underneath the first rail and a sixth channel at the front half of the base boom and underneath the second rail; and a top front link of the scissor links assembly configured to:

fit into the fifth channel and sixth channel; and slide along a longitudinal direction of the fifth channel and the sixth channel when the scissor links assembly folds or unfolds a second crossbeam connecting the third rail to the fourth rail a top boom comprising:

a fifth rail configured to be inserted into the third channel such that the fifth rail telescopically extends and retracts along the horizontal plane;

a sixth rail configured to be inserted into the fourth channel such that the sixth rail telescopically extends and retracts along the horizontal plane; and a working floor connecting the fifth rail to the sixth rail, wherein the working floor provides a platform for an individual to move about, wherein:

the power hoist is configured to extend and retract at least one of the middle boom or the top boom relative to the base boom; and the counterweight is a threshold weight to counterbalance the scissor-boom lift such that when at least one of the scissor-link assembly, the base boom, the middle boom, or the top boom are extended the scissor-boom lift remains in an upright position;

a second pulley vertically is mounted at a front end of the third channel of the middle boom;

a third pulley vertically mounted at a front end of the fourth channel of the middle boom;

a fourth pulley horizontally mounted at a rear end of the fifth rail of the top boom;

a fifth pulley horizontally mounted at a rear end of the six rail of the top boom;

a first cable comprising:

a first end anchored to a rear end of the first channel on the base boom; and a second end extending over the second pulley, turns at 180 degrees, extends over the fourth pulley on the top boom, turns at 90 degrees, extends over the fifth pulley on the top boom, turns at 90 degrees, extends to the third pulley on the middle boom, turns at 180 degrees, and is finally anchor to a rear end of the second channel on the base boom, wherein when middle boom extend out along the first and second channel, the second pulley and third pulley push the first cable to pull the top boom such that the top boom extents out simultaneously together with the middle boom;

a sixth pulley and a seventh pulley that are horizontally mounted at a front end of the base boom, wherein the sixth pulley is on a right side of the first pulley and the seventh pulley on a left side of the first pulley; and an eighth pulley vertically mounted at the right rear end of the middle boom;

a ninth pulley is vertically mounted at the left rear end of the middle boom;

a third cable comprising:

a first end anchored to a front end of the fifth rail on the top boom; and a second end goes that extends over to the eighth pulley, turns at 180 degrees, extends over to the eighth pulley, turns at 90 degrees, extends to the ninth pulley, turns at 90 degrees, extends to the sixth pulley, turns at 180 degrees, and is anchored to a front end of the sixth rail on the top boom, wherein when middle boom retracts, the eighth pulley and ninth pulley push the middle boom such that the middle boom retracts simultaneously together with the top boom.

2. The scissor-boom lift of claim 1, wherein;

the middle boom is configured to nest in the base boom through the first channel and the second channel to allow the middle boom to slide in and out from the front of the base boom; and the top boom is configured to nest in the middle boom through the third channel and the fourth channel to allow the top boom to slide in and out from the front of the middle boom.

3. The scissor-boom lift of claim 1, wherein:

the base boom has open top and open rear end, the open top on the base boom allows the top boom to side in and out during an extension or retraction of telescopic boom assembly; and the middle boom has open top and open rear end, the open top on the middle boom allows the top boom to side in and out during the extension and retraction of the telescopic boom assembly.

4. The scissor-boom lift of claim 1, wherein:

the power hoist is mounted at a rear end of base boom;

a first end of second cable rewinds to the power hoist;

a second end of second cable extends over the first pulley, turns at 180 degrees, anchors to a rear of the middle boom and rewinds into the power hoist; and the power hoist, second cable and the first pulley form a close loop.

5. The scissor-boom lift of claim 1, wherein the top boom further comprises:

hand rails on 4 sides of the top boom; and a first door on a back end of the top boom.

6. The scissor-boom lift of claim 5, wherein the working floor is divided into a front section and a rear section along a longitude direction of the scissor-boom lift, wherein:

the front section of the working floor includes a partial floor that covers a portion of the front section; and the rear section includes a full floor that covers the rear section; and the front section and the rear section being separated by a second door, wherein the second door is a swing door.

7. The scissor-boom lift of claim 4, wherein:

the power hoist is a hydraulic motor or an electric motor; and the first cable or the second cable is a rope or a chain.

8. The scissor-boom lift of claim 1, wherein the chassis further comprises:

a driving motor connected to the first set of wheels, the driving motor configured to control the first set of wheels; and a drawer on a side of the chassis next to one of the first set of wheels, the drawer being configured to hold a battery, an engine or a hydraulic system, wherein the drawer acts as the counterbalance when the top boom extends forward.

9. The scissor-boom lift of claim 8, further comprises a control box comprising:

a platform controller configured to control the power hoist to extend or retract at least one of the middle boom or the top boom; and a travel controller configured to control engage the drive motor to control the first set of wheels.

10. A scissor-boom lift, comprises:

a chassis comprising:

a body;

a first set of wheels connected to a front of the body;

a second set of wheels connected to a back of the body; and a counterweight connected to the back of the body;

a scissor links assembly connected to a top of the body of the chassis, wherein the scissor links assembly comprises a first link pivotally interlinked with a second link, wherein the first link and second link are configured to fold and unfold to raise and lower along a vertical axis, respectively;

a base boom connected to a top of the first link and a top of the second link, the base boom comprising:

a power hoist;

a first rail with a first channel extending along a side of the first rail;

a second rail with a second channel extending along a side of the second rail;

a first crossbeam connecting the first rail to the second rail;

a pivot pin bracket at a bottom front end of the base boom;

a first control cable bracket at a back end of the base boom;

a middle boom extension pulley mounted at a middle of the bottom front end of the base boom; and a top boom retraction pulley mounted at a bottom front end of the base boom;

a middle boom comprising:

a third rail configured to be inserted into the first channel such that the third rail telescopically extends and retracts along a horizontal plane relative to the base boom, wherein the third rail includes a third channel extending along a side of the third rail;

a fourth rail configured to be inserted into the second channel such that the fourth rail telescopically extends and retracts along the horizontal plane relative to the base boom, wherein the fourth rail includes a fourth channel extending along a side of the fourth rail;

a second crossbeam connecting the third rail to the fourth rail;

a vertical extension cable pulley mounted at front end of the middle boom;

a retraction cable pulley mounted at a bottom back end of the middle boom;

a control cable retractable drum mounted at the back end of the middle boom;

a middle boom extension cable with a first end connecting to the power hoist and a second end that is fixed to a bottom rear of the middle boom; and a middle boom retraction cable with a first end connecting to the power hoist and a fixed to the bottom rear of the middle boom;

a top boom comprising:

a fifth rail configured to be inserted into the third channel such that the fifth rail telescopically extends and retracts along the horizontal plane;

a sixth rail configured to be inserted into the fourth channel such that the sixth rail telescopically extends and retracts along the horizontal plane;

a pivoted sliding block connected to a back end of the top boom;

a horizontal extension cable pulley mounted to the top boom approximate the sliding block;

a second control cable bracket mounted at the back of the top boom;

a top boom extension cable with a first end connecting to the power hoist and a second end that is fixed to the bottom rear of the top boom;

a top boom retraction cable with a first end connecting to the power hoist and a fixed to the bottom rear of the top boom; and a working floor connecting the fifth rail to the sixth rail, wherein the working floor provides a platform for an individual to move about, wherein:

the power hoist is configured to extend and retract at least one of the middle boom or the top boom relative to the base boom; and the counterweight is a threshold weight to counterbalance the scissor-boom lift such that when at least one of the scissor links assembly, the base boom, the middle boom, or the top boom are extended the scissor-boom lift remains in an upright position.

* * * * *